US005269104A

United States Patent [19]

DiBiagio

[11] Patent Number: 5,269,104

[45] Date of Patent: Dec. 14, 1993

[54] HAND HELD WORK PREPARATION DEVICE

[76] Inventor: Angelo DiBiagio, 3214 Division St., Easton, Pa. 18042

[21] Appl. No.: 858,315

[22] Filed: Mar. 25, 1992

[51] Int. Cl.[5] ..... B24B 23/02; A46B 13/02

[52] U.S. Cl. ..... 51/170 R; 51/181 R; 51/170 PT; 15/23; 15/88; 15/104.03

[58] Field of Search ..... 51/181 R, 181 NT, 170 R, 51/170 PT, 245; 15/104.11, 104.03, 104.04, 104.05, 104.09, 104.95, 88, 23

[56] References Cited

U.S. PATENT DOCUMENTS

| | | | |
|---|---|---|---|
| 1,870,349 | 8/1932 | Taylor | 15/23 |
| 1,959,307 | 5/1934 | Sanger | 15/23 |
| 2,076,998 | 4/1937 | Martindale | 51/170 PT |
| 2,489,102 | 11/1949 | Moore | 51/170 PT |
| 2,749,563 | 6/1956 | Resser, Sr. | 51/170 PT |
| 2,793,473 | 5/1957 | Hickman | 51/73 R |
| 3,793,782 | 2/1974 | Bowling | 15/23 |
| 4,238,867 | 12/1980 | Ruggero et al. | 15/88 |
| 4,246,728 | 1/1981 | Leasher | 51/245 |
| 4,530,127 | 7/1985 | Roberts | 15/104.09 |
| 5,056,265 | 10/1991 | Hurst | 15/104.04 |

*Primary Examiner*—Roscoe V. Parker
*Attorney, Agent, or Firm*—John Lezdey

[57] ABSTRACT

This disclosure relates to a work preparation device for sequentially conditioning a tubular workpiece. The device has a battery operated motor that operates gear means that rotates a horizontal shaft. At the ends of the shaft is a male abrasive tool and a female abrasive tool. The distance between the ends of the abrasive tools is preferably less than about six inches so that the device could function in small spaces.

7 Claims, 3 Drawing Sheets

HAND HELD WORK PREPARATION DEVICE

FIELD OF THE INVENTION

The present invention relates to a portable hand held work preparation device which can accomplish at least two work related steps without interruption. More particularly, the invention provides a hand held device for performing dual operations, such as abrading and cleaning, in small and difficult locations without changing tools or leaving the area.

BACKGROUND OF THE INVENTION

In fluid systems for homes, other buildings, vehicles and the like, it is customary to cut either metallic or plastic tubing to appropriate length and then connect them with suitable couplings. Usually the end of each tubing is telescoped into a coupling, and the coupling or tube are soldered or adhesively bonded together. In either event, precleaning of the surfaces being secured together is essential. When new tubing is being installed the workman can prepare the tubing on a workbench prior to installation. However, in the case of repairs of preexisting plumbing, it is not possible or practical to bring all of the parts to a workbench for cleaning. The tubing may be located in hard to reach locations where portions of the tubing must be repaired and or replaced. In either case, the existing tubing must be prepared for bonding if a firm and permanent bond is to be obtained.

In the past, in the installation of plumbing the most common practice has been manual abrasive cleaning of the surfaces to be bonded together with emery cloth. Attempts have been made to provide machines for cleaning and preparing the surfaces of tubing. However, these prior art devices were unduly complex, expensive and could not perform in a space of less than six inches.

In addition, the previous devices normally performed a single function such as cleaning or abrading and then work had to be stopped to replace a part to perform a further function. It is essential that after abrading that the surface be cleaned. In hard to reach areas the interruption of operations could result in prolonged preparation or further adjustments to complete the work.

To make field repairs to vehicles or other parts and installations away from conventional electrical outlets, battery operated or rechargeable systems which do not require outside electrical energy is essential if other than manual means is to be employed. It is desired that the device be multi-functional in that a variety of tool endings can be used. That is, a portable hand held device which can perform the functions of cleaning, abrading, screw driving, etc., by replacement tool ends is preferred by mechanics and/or hobbyists.

U.S. Pat. No. 2,793,473 to Hickman discloses a multi-tool cleaning and reaming device for metallic fittings and tubings. The device is of the type which requires the tubing to be brought to a work bench.

U.S. Pat. No. 4,238,867 to Ruggero et al discloses an I-shaped tube abrading and cleaning tool having a male abrasive tool at one end and a female abrasive tool at the other end. The tool has the disadvantage in that it cannot be used in close spaces because the two abrading tools and housing are aligned.

U.S. Pat. No. 4,246,728 to Leasher discloses a cleaning and deburring tool which can be used in connection with the present invention.

U.S. Pat. No. 4,530,127 to Roberts discloses a tool having opposed cleaning heads for sequentially engaging and cleaning the opposed threaded ends of pip points. The tool is of the type wherein pipes are brought to the tool and repairs in small spaces are not possible.

SUMMARY OF THE INVENTION

According to the present invention there is provided a portable work preparation device for sequentially conditioning a tubular workpiece. The device comprises a cylindrical housing with an electrical motor mounted in the housing. The housing also contains an electrical battery means which is electrically connected to operate the motor. The motor drives a vertical output shaft member. The vertical shaft is connected to gear means which rotatably drives a horizontal shaft. The horizontal shaft has a workpiece preparation tool attached to each end of the shaft and rotatable with it.

Advantageously, the distance between the ends of the work preparation tool is less than about six inches so as to be able to be used in small places.

Generally, the work preparation tool comprises a female abrasive tool on one end and a male abrasive tool on the other end. The workpiece is prepared by using first one tool on the workpiece and then turning the device 180° to use the other tool.

Accordingly, it is a general object of the invention to provide a portable multi-functional device for preparing the surface of a workpiece.

It is another object of the invention to provide a device which can be used to clean and abrade tubing in small spaces without changing tools.

It is a yet another object of the invention to provide a device capable of performing several operations by attachment of various tool ends.

It is a still further object of the invention to provide a portable cleaning tool for use by plumbers, mechanics, and the like.

Other objects and advantages of the instant invention, as well as the invention itself, will become more apparent by reference to the disclosure and claims that follow, as well as the appended drawings.

DESCRIPTION OF THE PREFERRED EMBODIMENTS

Figure 1:
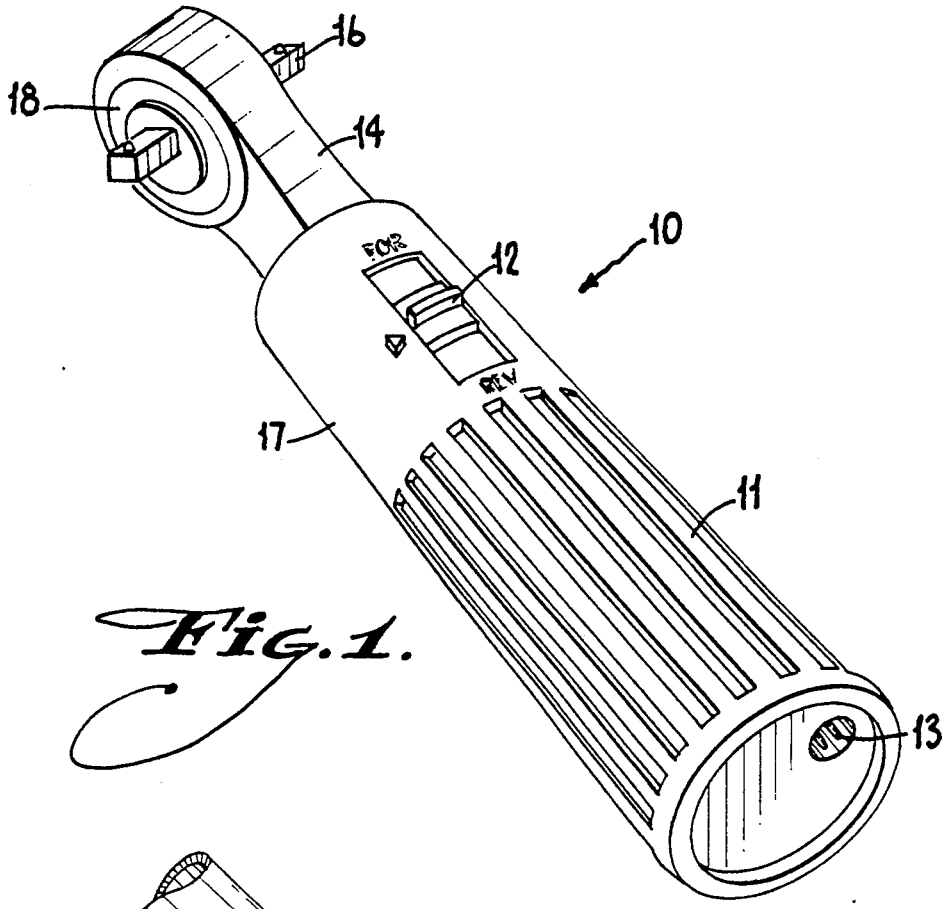
FIG. 1 is a perspective view of the device of the invention without the work preparation tools.

Although specific terms are used in the following description for the sake of charity, these terms are intended to refer only to the particular structure of the invention selected for illustration in the drawings, and are not intended to define or limit the scope of the invention.

As shown in FIG. 1, the work preparation device 10 of the invention is a portable hand device. The lower portion 11 houses a rechargeable battery means (not shown) with an electrical connector 13. The upper portion 17 has a switch 12 for electrically connecting an electric motor to cause shaft 16 to rotate in the roller bearing journal 18 of the head 14. The switch 12 permits rotation of the shaft 16 in either direction.

Figure 2:
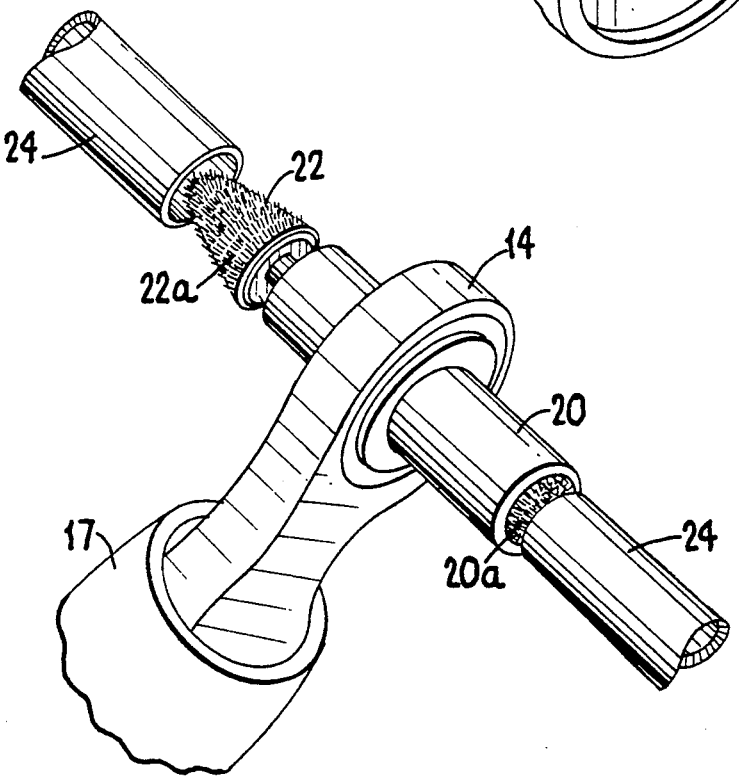
FIG. 2 is a partial perspective view of the device of FIG. 1, with a male and female cleaning tool.

FIG. 2 shows one form of arrangement which can be used, namely, a male cleaning and/or abrasive tool 22 with wire bristles 22*a*. Tool 22 is used to clean a tubular workpiece in preparation for soldering or adhesive connection. The other side of the shaft 16 at a 180° angle is connected to a female cleaning tool 20 having wire bristles 20*a* for cleaning the outside of the tubing 24. It can be seen that by mere rotation of the device 10 permits cleaning of the inner and outer surfaces of a tubular workpiece. The distance between the ends of the tools 20, 22 is advantageously less than about six inches in most cases so as to permit use of the tool in small spaces. The small distance between tools and the T-shape arrangement permits access to work areas which are not only difficult to reach but by removal of one of the work preparation tools, the device can be manipulated to work at different angles. Besides plumbing, the device of the invention can be used in auto and home repairs.

Figure 2A:
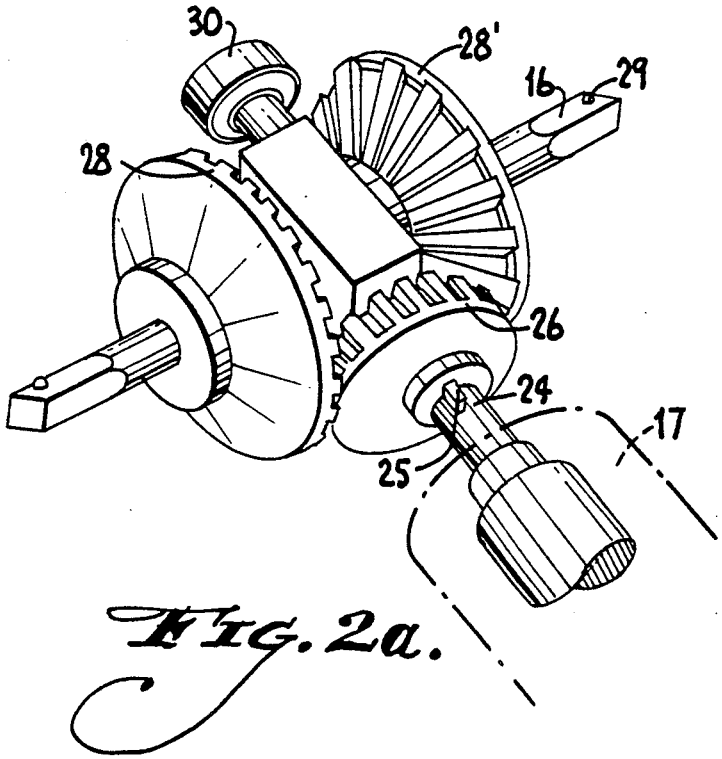
FIG. 2*a* is an enlarged perspective of a mechanism operating the horizontal shaft.

FIG. 2*a* illustrates the drive for the shaft 16 that provides a heavy duty action. As shown, there is extended from motor 23 a vertical shaft 25. The shaft 25 has a bevel gear 26 in abutment with a stop 25 on the shaft 24. The bevel gear 26 meshes with a pair of pinion gears 28, 28'. The pinion gears 28, 28' have journaled therein a horizontal shaft 16 with tapered ends and protrusions 29 for association with a quick release mechanism on the tools to be attached. The shaft 29 can comprise a single shaft or a double shaft. As a result of using a pair, of pinion gears 28, 28' the work preparation tools which are used can encounter strong resistance and still rotate. At the end of the shaft 24 there may be placed a roller bearing journal which is positioned within a space in the head portion 14.

Figure 2B:
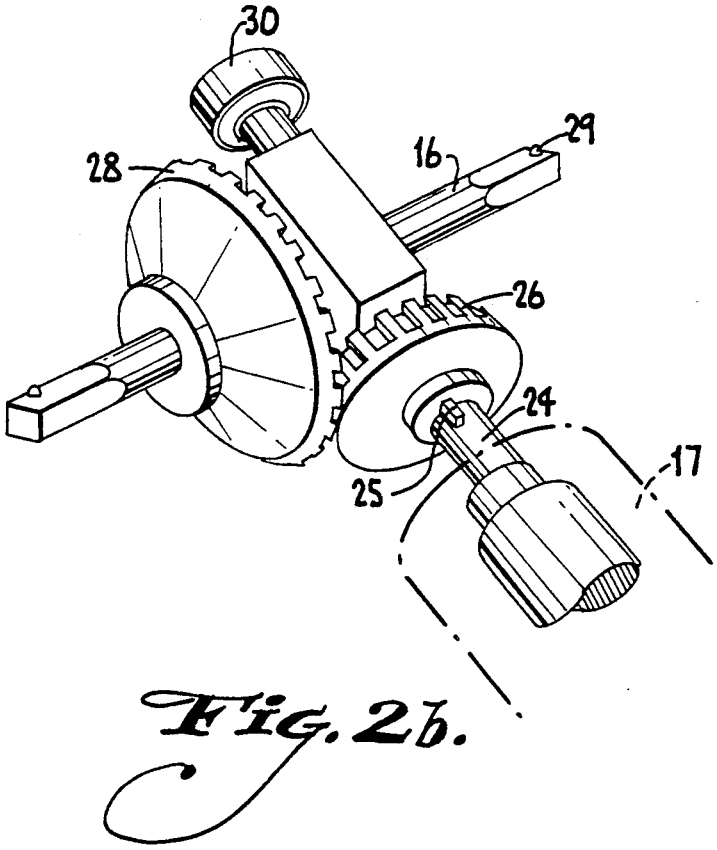
FIG. 2*b* is an enlarged perspective view of another mechanism for operating the horizontal shaft.

FIG. 2*b* is similar to FIG. 2*a* except that a single pinion gear 28 is utilized and the shaft 16 is a single continuous shaft. The arrangement is suitable for rotating the work preparation tools where only slight preparation may be required, for example, plastic tubing. The device with a single pinion gear is inexpensive to manufacture and can be prepared using conventional motors and battery packs.

Figure 3A:
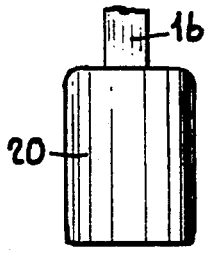
FIGS. 3*a*–3*c* illustrate female abrasive tools of different diameters.
Figure 3B:
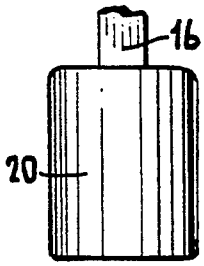
Figure 3C:
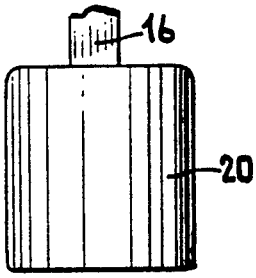
Figure 4:
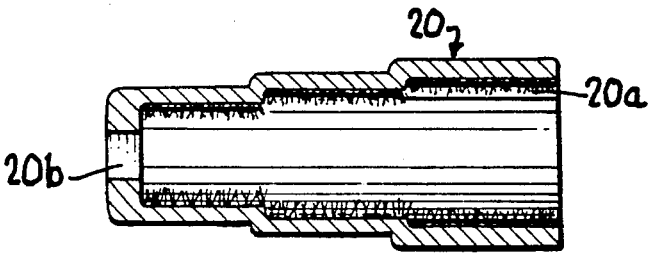
FIG. 4 is a cross-section view of a multi-stepped female cleaning tool.

FIGS. 3*a*-3*c* illustrate the different size female abrasive means 20 which can be used with different sized tubes 16. However, advantageously a single female preparation tool 20 is employed which is provided with areas of different diameters as illustrated in FIG. 4. The tool 20 with wire bristles 20*a* has a opening 20*b* which connects with the tapered end 29 of the shaft 29. Preferably, a quick release mechanism is provided with the tool.

Figure 5:
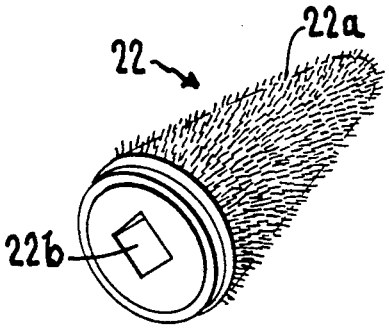
FIG. 5 is a perspective view of a male cleaning tool.

While wire bristles 22*a* are shown in connection with the male preparation tool 22 of FIG. 5. It is understood that other types of abrasive or work preparation surfaces may be utilized, for example, pumice stone. Also, when the device 10 is used for auto or home repairs there may be tool inserts such as screw drivers, wrenches, etc., adapted for attachment.

Figure 6:
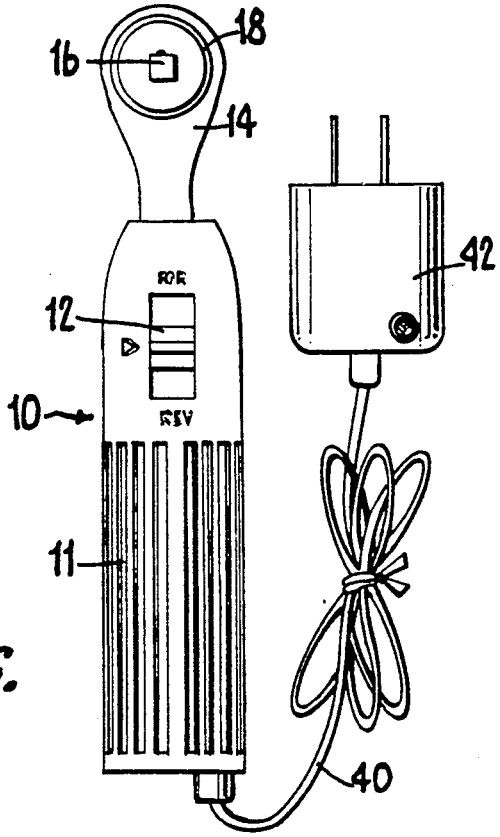
FIG. 6 is a perspective view of the device of the invention with a recharging device.

FIG. 6 illustrates the preferred embodiment of the invention wherein the device 10 is provided with an electrical cord 40 having a means 42 for recharging the battery.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A portable hand held work preparation device for sequentially conditioning a tubular workpiece comprising a cylindrical housing;

an electrical motor mounted within said housing, electrical battery means mounted within said housing and electrical connected to operate said motor;

a vertical driven output shaft member connected to said motor and rotated thereby;

gear means operatively connected and driven by said vertical shaft member;

a horizontal shaft rotatably driven by said gear means, a workpiece preparation tool attached to each end of said horizontal shaft and rotatable with it, the distance between the work preparation tools being less than six inches.

2. The work preparation device of claim 1 wherein one of said work preparation tool is a female abrasive tool and the other work preparation tool is a male abrasive tool.

3. The work preparation device of claim 2 wherein said male abrasive tool is a brush.

4. The work preparation device of claim 1 in which said motor is reversible.

5. The work preparation device of claim 1 wherein each of said work preparation tool is cooperatively secured to said horizontal shaft by a quick release mechanism.

6. The work preparation device of claim 1 wherein said gear means comprises a bevel gear and a bevel pinion.

7. The work preparation device of claim 1 wherein said gear means comprises a bevel gear and a pair of bevel pinions.

* * * * *